US005900276A

United States Patent [19]

Sooklaris

[11] Patent Number: 5,900,276

[45] Date of Patent: May 4, 1999

[54] METHOD FOR TIGHTENING ARTIST'S CANVAS

[76] Inventor: John M. Sooklaris, 1550 Jackson St., #2, San Francisco, Calif. 94109

[21] Appl. No.: 08/908,864

[22] Filed: Aug. 8, 1997

[51] Int. Cl.[6] ..... B32B 35/00

[52] U.S. Cl. ..... 427/140; 427/171

[58] Field of Search ..... 427/140, 171; 160/374.1

[56] References Cited

U.S. PATENT DOCUMENTS 3,092,888 6/1963 Mizell .
3,280,143 10/1966 Hayes .
3,831,200 8/1974 Weiss .
4,052,521 10/1977 Ferrari ..... 427/173
4,234,621 11/1980 Fieux ..... 427/140
4,286,955 9/1981 Lewis ..... 8/115.6

*Primary Examiner*—Shrive Beck
*Assistant Examiner*—Fred J. Parker
*Attorney, Agent, or Firm*—Thomas M. Freiburger

[57] ABSTRACT

A method for restretching artist's canvases which have relaxed and lost tension through time and environmental effects includes application of a liquid material, preferably a water based adhesive, to the back surface of the relaxed canvas, which may or may not have a painting on its front surface. The wetting of the canvas tightens the fibers, and when the water based adhesive material dries in the canvas, the canvas remains tight. Several methods of application are disclosed.

17 Claims, 1 Drawing Sheet

METHOD FOR TIGHTENING ARTIST'S CANVAS

SPECIFICATION

BACKGROUND OF THE INVENTION

This invention generally is concerned with artist's materials, and more specifically the invention is addressed at the problem of artist's fabrics or canvases becoming loosened on their frames over time.

Due primarily to environmental factors and also due to the nature of fibers used in artist's fabrics, stretched on a frame, these fabrics tend to lose tension over time. Environmental factors can include variations in humidity or temperature, as well as varying exposure to light or other conditions.

The term "artist's fabrics" is intended to include the traditional canvas as well as other fabrics sometimes used by artists, stretched on a frame. The term is not limited to art works painted on canvas and also includes fabrics used for "canvas transfers", a process of transferring an image on paper to a traditional artist canvas to give the look of an original. The fabrics include (but are not limited to) cotton fabrics, linen fabrics, poly-cotton fabrics and burlap.

There have been attempts to correct the problem of relaxed, sagging canvases or fabrics. When a painting (or other art work) has been applied to the front surface of the artist's fabric, care must be taken not to damage the art work. In the past, wedges have been used at the edges of the frame, in the inside corners of the stretcher bar frame, to restretch the canvas by expanding the size of the frame. This strictly mechanical approach is somewhat time consuming and has the potential to damage the art work such as by cracking the paints on the surface. Moreover, the wedges have traditionally been supplied with every artist canvas, and they have been misused to expand canvases or fabrics which were not loose. Still further, the expanded frame may no longer fit a decorative outer frame. In addition, a canvas which has become loose may have only one area or zone which is loose or rippled, and the technique of expanding the whole frame will not address such local ripples but will require stretching the entire canvas or fabric in order to retension the subject zone.

Another technique used to retension canvas has been to remove the canvas from the stretcher bar frame and re-stretch it. This is very time consuming; however, many artist canvases today lack the capability of expanding because the wood frame is cut with miter joints that when joined together remain fixed with fasteners of various types. In that case the only technique available for retensioning the canvas has been to remove the canvas from the frame and restretch it.

The following U.S. patents show methods and techniques involving treatment of fabrics: U.S. Pat. Nos. 3,092,888 (Mizell), 3,280,143 (Hayes), 3,831,200 (Weiss) and 4,286,955 (Lewis).

It is among the objects of this invention to provide a simple and inexpensive technique for tensioning an artist's fabric on a frame.

SUMMARY OF THE INVENTION

The method of the invention achieves a quick and essentially permanent retensioning of a sagged or loosened canvas or other frame-mounted artist's fabric in a simple and low cost fashion, avoiding mechanical retightening devices and methods and avoiding removal and restretching of the artist's fabric.

In one preferred embodiment, the method of the invention comprises applying to the back of the fabric a water-based liquid material including a settable medium which sets upon drying, the liquid material thus causing the fabric when wetted to tighten on the frame; and drying the fabric and thus causing the material to set on the fabric, thereby retaining the fabric in the tensioned state. The drying step can be by air and/or heat application, or by simply allowing the fabric to dry in air.

In one specific embodiment of the method, the water-based liquid material used is an adhesive product. One adhesive product which has been found effective is poly vinyl acetate (PVA) sold by H. B. Fuller Co. Other adhesives of generally similar composition are also effective.

One potential problem with certain adhesives on artist's fabrics used for particular artworks is the potential to generate acetic acid at the back in the fabric. The PVA adhesive mentioned above can generate acetic acid to about 3.5 pH or 4.0 pH, which can present a problem in the long run. Some artworks are susceptible to break down in the presence of acid.

The water-based material may be applied by spraying, brushing or other means. It is generally sufficient to thoroughly coat the back surface of the artist's fabric, being sure to apply enough material to soak the fabric's fibers at least at the outer surface, such that the back surface of the fabric appears to be wetted. In one embodiment, the thickness of the applied material is at least about 0.001 inch.

It has been found that several liquid-based settable materials, with some adhesive property, are effective having a solids content in the range of about 12 to 55 percent. This includes the PVA adhesive above, as well as acrylic material described below.

One alternative to the PVA adhesive is a water-based acrylic which has been used as a fabric stiffener primarily for needlecraft, not sold as an adhesive, in particular such an acrylic sold by H. B. Fuller Co. The controlling property of an effective water-based material appears to be that the material have a settable medium which is capable of acting as a binder on a woven fabric material, with some adhesive property, particularly on a fabric formed of natural fibers. The settable binder material appears to act on the fibers themselves, possibly entering the strands of fibers and residing between the individual very small fibers themselves, to lock them into the configuration wherein the fabric has shrunk or tightened. In addition, the binder material also may act on the exterior surface of the fabric in general, providing a contiguous sheet of dried binder which helps lock in the tightened configuration.

It is accordingly an object of the invention to improve over prior procedures for retightening artist's fabrics on frames, with a simple and cost effective method. These and other objects, advantages and features of the invention will appear from the following description of the preferred embodiments considered in conjunction with the accompanying drawings.

DESCRIPTION OF THE PREFERRED EMBODIMENTS

Figure 1:
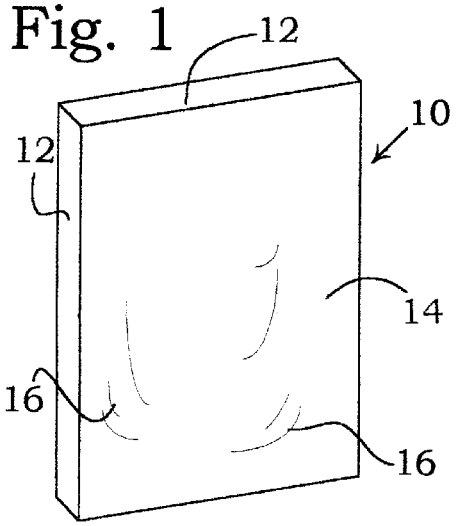
FIG. 1 shows a typical artist's fabric or canvas, originally stretched on a frame, but which has lost tension.

In the drawings, FIG. 1 shows an artist's canvas or artist's fabric 10 which has been stretched and mounted on a frame, the edges of which are not seen in FIG. 1 but which are behind the flat edges 12 of the mounted artist's fabric. The fabric or canvas 14 has loosened over time, and has wrinkles or ripples or loosened areas 16.

Figure 2:
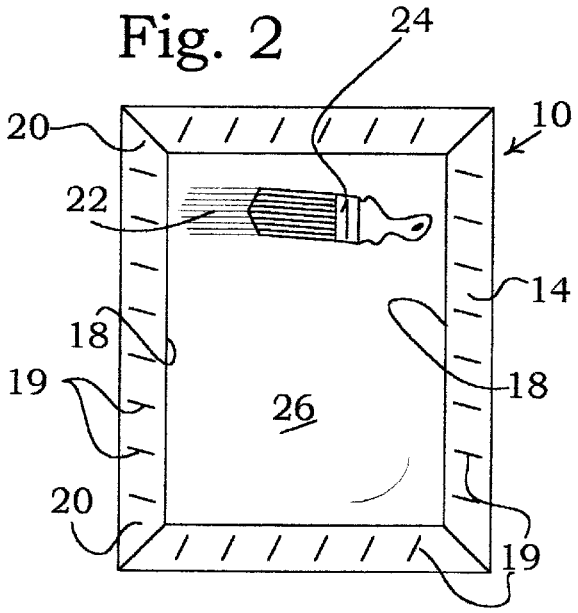
FIG. 2 schematically indicates application of a water-based material to the back of the artist's fabric, in accordance with the invention.

FIG. 2 shows the back side of the mounted artist's fabric 10, revealing the fabric 14 overlapping the back of the stretcher bars or frame 18. As is typical with many artist's fabrics, the lapped over portion of the fabric 14 is stapled at 19 to the wooden frame or stretcher bars 18. The fabric is shown cut or folded generally in mitered configuration 20 at corners, although other configurations can be used in this regard.

FIG. 2 shows an embodiment of the method of the invention, in which the water based binder material 22 is applied with a brush 24 to the back surface 26 of the canvas or fabric. In most cases the water based binder material is applied evenly to the back of the fabric, although it can be applied to selected rippled or locally loosened fabric zones if desired. As noted above, the liquid binder material may also be applied by other means, such as rolling, spraying or troweling.

Figure 3:
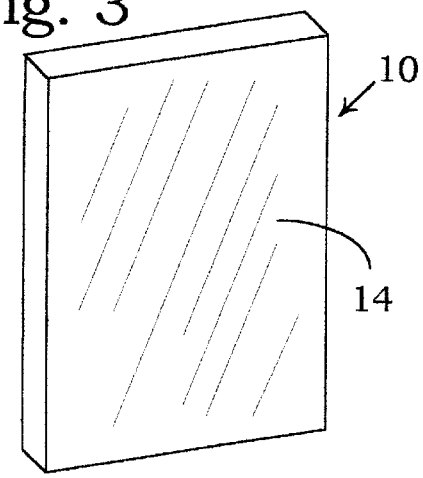
FIG. 3 shows the artist's fabric after application of the water-based material, with the fabric retensioned to a tight configuration.

FIG. 3 shows the artist's fabric 10 from the front side as in FIG. 1, but with the fabric 14 retensioned by application of the water based liquid binder material. As explained above, the wetting of the back surface of the fabric with the liquid material causes retensioning of the fabric, to the tightened, retensioned configuration shown in FIG. 3. The back of the artist's fabric may be dried using a blower, with or without heat; or it can simply be allowed to air-dry.

Below are set forth some examples of tests involving use of a liquid water based binder material on artist's fabrics which had lost tension and become loosened over time. In these tests, the liquid material used was a PVA adhesive unless otherwise noted. In all the examples the fabric was a traditional artist's canvas. Three methods of measuring tension were used in these examples: (1) The "thunderstorm test" involves shaking the canvas back and forth to listen whether the canvas flops about and makes a sound resembling thunder. This would generally indicate a very loose canvas. (2) The "drum test" involves tapping one's finger 3 on the canvas to listen for the audible tone produced. The higher note produced, the greater the tension. A piano was used to match the tone produced by tapping on the canvas (as noted in the "tone" column of the chart that follows). (3) The Newton meter test uses a tension meter or Newton meter placed on top of the horizontally-positioned stretched canvas to give a value of tension in Newtons per square centimeter, approximating canvas tension. Even though these tests were carried out as objectively as possible, there is some element of subjectivity in all methods of testing. Note also that not every example has all three forms of tension test performed, both before and after the application of the liquid water based material.

| | | | Applica- | | BEFORE APPLICATION | | | | AFTER APPLICATION | | | |
|---|---|---|---|---|---|---|---|---|---|---|---|---|
| No. | Str. Canvas Type | Material | tion | Amount | Newtons | Tone | Sound | Days | Newtons | Tone | Sound | Comment |
| 1 | 16 × 20 PreGessoed Cotton | Acrylic 12% | Spray | Light | 3.8 | F# | None | 7 | 4 to 4.5 | F# | None | Transparent |
| 2 | 16 × 20 PreGessoed Cotton | PVA 41% | Brush | Light | 2.8 | F | Thunder | 7 | 5 to 6 | A | None | Transparent |
| 3 | 16 × 20 PreGessoed Cotton | Acrylic 12% | Spray | Light | 2 | F | Thunder | 4 | 3.5 to 4.5 | F# | None | Transparent |
| 4 | 16 × 20 PreGessoed Cotton | PVA 41% | Brush | Light | 3.2 | F# | None | 7 | 4.5 to 5.5 | F# | None | Transparent |
| 5 | 16 × 20 PreGessoed Cotton | PVA 41% | Brush | Light | 3.5 | F | None | 7 | 5 to 6 | F# | None | Transparent |
| 6 | 48 × 48 Acrylic Painting | Acrylic 12% | Spray | Light | 2 to 3 | | Thunder | 1 | 2.5 to 3.5 | F# | None | Transparent |
| 7 | 16 × 20 PreGessoed Cotton | Water | Spray | Soaked | 3 to 3.75 | | | 7 | 2.8 to 3.5 | F | None | Transparent |
| 7 | 16 × 20 PreGessoed Cotton | Water | Spray | Soaked | 3 to 3.75 | | | 50 | 2.0 to 2.8 | F | None | Transparent |
| 8 | 16 × 20 PreGessoed Cotton | Water | Spray | Moderate | | | | | | | None | Transparent Leaves Opaque |
| 9 | 16 × 20 PreGessoed Cotton | Gesso | Brush | Moderate | 3.0 to 3.6 | Ab | | 50 | 3.8 to 4.8 | F | None | Residue |
| 10 | 20 × 24 Image Transfer | PVA 41% | Brush | Light | 2 to 2.5 | | Thunder | 315 | 4 | | None | Transparent |
| 11 | 16 × 20 Litho . . . Sloppy Loose | PVA 41% | Brush | Heavy | Too Loose | | Thunder | 7 | 3 to 3.5 | | None | Transparent |
| 12 | 16 × 20 PreGessoed Linen | PVA 41% | Brush | Light | 1.6 to 2.6 | G | | 3 | 3.5 to 4.9 | F# | None | Transparent |
| 12 | 16 × 20 PreGessoed Linen | PVA 41% | Brush | Light | 1.8 to 2.6 | G | | 49 | 3.9 to 4.5 | F# | None | Transparent |
| 13 | 16 × 20 PreGessoed Linen | PVA 41% | Brush | Light | 2 to 3 | F | | 3 | 3.5 to 4.8 | F# | None | Transparent |
| 13 | 16 × 20 PreGessoed Linen | PVA 41% | Brush | Light | 2 to 3 | F | | 49 | 3.5 to 4.5 | F# | None | Transparent |
| 14 | 16 × 20 Unprimed Cotton | Acrylic 12% | Spray | Heavy | 0 to .625 | | | 43 | 1.8 to 3.0 | F# | None | Transparent |
| 15 | 16 × 20 Unprimed Cotton | Acrylic 12% | Spray | Moderate | 0 to 0.5 | | | 43 | 0.3 to 1.0 | F# | None | Transparent |
| 16 | 16 × 20 PreGeseoed Linen | Water | Spray | Moderate | 3.0 to 3.6 | F | | 8 | 3.0 to 3.8 | F# | None | Transparent |
| 16 | 16 × 20 PreGessoed Linen | Acrylic 12% | Spray | Moderate | 3.0 to 3.8 | F | | 42 | 3.5 to 3.9 | F# | None | Transparent |

As indicated, the examples included the use of an acrylic material, the PVA adhesive, gessoe, and a control comparison of plain water. The water, in examples 7 and 16, illustrates that plain water, although it will tension a canvas temporarily, as long as the fabric is wet, does not do any permanent improvement. In example 16, the same pregessoed linen was first treated with water, observed after 8 days, then treated with the acrylic material and observed after a further 42 days. The example shows essentially no long-term change following the water treatement, but a significant increase in tension after treatment with the acrylic material.

In each example, each reported Newton reading represents nine measurements taken. Where a single value is given, as in the "before application" in examples 1–5, the nine readings were averaged. In other cases, where a range is given, these are simply the high and low ends of the range.

It was noted that with the acrylic material, the amount of material applied to the artist's fabric was more critical than in the case of the PVA adhesive material. Thus, examples 14 and 15 show that, with unprimed cotton a dramatic increase in tension was achieved with a heavy spray of the acrylic material (at only 12% solids, relatively thin material), whereas a moderate spray of the same material achieved only a small improvement in tension. With the PVA adhesive material, a light application was often sufficient to achieve a considerable increase in tension, essentially maintained over time.

In many cases the successfully treated artist's fabric will relax slightly over time. Illustrating this are examples 12 and 13, wherein the artist's fabric was observed at three days and again at 49 days.

The examples show that the method of the invention is effective in achieving a significant increase in stretch canvas or artist's fabric, and that most of this increased tension is maintained over time. This is achieved with a very simple and relatively inexpensive procedure.

The above described preferred embodiments are intended to illustrate the principles of the invention, but not to limit its scope. Other embodiments and variations to this preferred embodiment will be apparent to those skilled in the art and may be made without departing from the spirit and scope of the invention as defined in the following claims.

I claim:

1. A method for tightening a relaxed artist's fabric on a framer and maintaining tension in the tightened fabric, comprising:

to the back of the loosened, relaxed fabric, applying a liquid water-based binder material having an adhesive property, in sufficient quantity on the fabric to wet the back of the fabric, thereby causing the wetted fabric to tighten on the frame, and allowing the liquid material to dry on the artist's fabric, whereby the water-based binder material holds the fabric fibers in a tightened, tensioned configuration.

2. The method of claim 1, wherein the step of applying the liquid material to the fabric comprises brushing the material on the fabric.

3. The method of claim 1, wherein the step of applying the liquid material to the fabric comprises spraying the material on the fabric.

4. The method of claim 1, wherein the liquid water-based binder material is applied to the fabric in an amount sufficient to place a liquid film of at least about 0.001 inch thickness on the back surface of the fabric.

5. The method claim 1, wherein the relaxed, loosened fabric has an oil painting on its front surface.

6. The method of claim 1, wherein the liquid water-based material comprises a PVA adhesive.

7. The method of claim 6, wherein the liquid water-based material has at least 12% solids content.

8. The method of claim 1, wherein the liquid water-based adhesive material has about 12% to 55% solids content.

9. A method for tensioning an artist's fabric which has been stretched onto a frame and which has loosened, comprising:

applying to the back of the fabric a water-based liquid material including a settable medium which sets upon drying with an adhesive property, the liquid material thus causing the fabric to tighten on the frame, and drying the fabric and thus causing the material to set on the fabric, thereby retaining the fabric in a tensioned state.

10. The method of claim 9, wherein the water-based liquid material comprises an adhesive.

11. The method of claim 9, wherein the water-based liquid material comprises an acrylic.

12. The method of claim 9, wherein the step of applying the liquid material to the back of the artist's fabric comprises spraying the liquid material onto the fabric.

13. The method of claim 9, wherein the fabric comprises a canvas formed at least in part by cotton fibers.

14. The method of claim 9, wherein the artist's fabric is formed of natural fibers.

15. The method of claim 9, wherein the water-based liquid material has a solids content of about 12% to 55%.

16. The method of claim 9, wherein the step of applying the liquid material to the fabric'comprises brushing the material on the fabric.

17. The method of claim 9, wherein the artist's fabric has art work applied to its front surface.

* * * * *